United States Patent [19]

Johnson

[11] 4,271,648

[45] Jun. 9, 1981

[54] SUBTERRANEAN DRAIN SYSTEM FOR BASEMENTS

[76] Inventor: David S. Johnson, 8660 Stone Bridge Trail North, Stillwater, Minn. 55082

[21] Appl. No.: 72,440

[22] Filed: Sep. 4, 1979

[51] Int. Cl.[3] ..... E02D 19/00

[52] U.S. Cl. ..... 52/169.5; 52/303; 52/198

[58] Field of Search ..... 52/169.5, 169.1, 131, 52/198, 302, 303, 209; 405/43–46; 137/357, 362

[56] References Cited

U.S. PATENT DOCUMENTS

| | | | |
|---|---|---|---|
| 1,329,028 | 1/1920 | Snyder . | |
| 1,951,219 | 3/1934 | Strand . | |
| 1,965,910 | 7/1934 | Schiller . | |
| 1,990,949 | 2/1935 | Maull . | |
| 2,703,002 | 3/1955 | Suskind . | |
| 2,703,911 | 3/1955 | Griffin | 52/303 |
| 2,717,513 | 9/1955 | Smart | 52/303 X |
| 2,840,867 | 7/1958 | Wilder | 52/303 X |
| 3,017,722 | 1/1962 | Smith | 52/303 X |
| 3,304,672 | 2/1967 | Bakke | 52/169.5 |
| 3,395,625 | 8/1968 | Blanchette et al. | 52/169.5 X |
| 3,413,769 | 12/1968 | Hoyt | 52/198 |
| 3,422,626 | 1/1969 | Hanrahan | 405/43 |
| 3,426,487 | 2/1969 | Forte | 52/169.5 X |
| 3,427,810 | 2/1969 | Petersen | 405/43 |
| 3,603,340 | 9/1971 | Rousselet | 52/198 X |
| 3,675,570 | 7/1972 | Mersfelder | 100/90 |
| 3,789,747 | 2/1974 | Wasserman et al. | 52/303 X |

FOREIGN PATENT DOCUMENTS

| | | | |
|---|---|---|---|
| 1238105 | 6/1960 | France | 52/303 |

*Primary Examiner*—J. Karl Bell

*Attorney, Agent, or Firm*—Orrin M. Haugen; Thomas J. Nikolai

[57] ABSTRACT

An apparatus for relieving static subterranean water heads surrounding subterranean walls which includes a perforated hollow sleeve arranged to extend through the subterranean wall and into a surrounding static water head. The sleeve has distal and proximal ends, with a plurality of spaced perforations being formed in the wall of the sleeve substantially along the length thereof. The distal end is tapered substantially to a pointed tip, and the tapered tip portion is of generally solid construction. A flanged coupling means is formed adjacent the proximal end for coupling water conduits internally thereof. When desirable, an imperforate sleeve means may be provided adjacent the proximal end for rendering a portion of the perforated hollow sleeve adjacent the proximal end substantially water-tight, thereby protecting paneling which may be pre-positioned in the subterranean wall.

3 Claims, 8 Drawing Figures

SUBTERRANEAN DRAIN SYSTEM FOR BASEMENTS

BACKGROUND OF THE INVENTION

The present invention relates generally to apparatus for relieving static subterranean water heads which surround subterranean walls, such as in residential basements, and other subterranean enclosures. Subterranean water levels vary from time to time depending upon rainfall, snow melt, and the like. In certain areas and locations, drainage problems may develop from time to time, depending upon weather and soil conditions, whereby the subterranean water level increases, generally temporarily, to a relatively high plane. When this occurs, basements may become partially flooded, thereby contributing to costly repairs and other difficult situations.

The present invention provides a means for controlably relieving subterranean water heads, whereby the subterranean water may be directed to a sewer outlet, either a storm sewer or a sanitary sewer. The zones being relieved will be those areas which surround the enclosure, and thus are unlikely to cause any substantial excessive load on any sewage treatment facility. When drainage from such relieved zones is coupled to a storm sewer, there would be, of course, no additional load imposed upon a sewage treatment facility.

Residential dwellings are frequently erected without knowledge of all of the subterranean water conditions. Frequently, during periods of drought, or even during periods of normal rainfall, the homeowner will not be subjected to any basement flooding. However, in certain unusual precipitation patterns or drainage events, the owner may be suddenly subjected to one or more flooding events. As such, means should be undertaken by the owner to relieve the subterranean water head adjacent the basement walls so as to reduce or eliminate the flooding by controlling the flow. The present arrangement makes it possible to either install a drainage facility when the building is erected, or, alternatively, retrofit such a structure when and if a flooding event occurs, so as to reduce or eliminate recurring incidents.

SUMMARY OF THE INVENTION

Generally, in accordance with the present invention, a perforated hollow sleeve means is provided which is arranged to extend through a subterranean wall and into a surrounding water head. The hollow sleeve is provided with spaced perforations generally along the length thereof, so as to receive and permit flow of water therethrough. The distal end is tapered substantially to a pointed tip, and the tip is preferably solid so as to provide additional strength when the device is driven into the surrounding subsoil. A flange coupling means is formed adjacent the proximal end of the hollow sleeve for coupling water conduits internally thereof. The internal coupling is normally used to receive the incoming water, but may be used, from time to time, for receiving water under pressure so as to flush out the openings and bores formed in the sleeve.

In actual use, a hole is driven in the basement wall, and the apparatus passed therethrough. The device extends for a distance, generally approximately 6 inches or more, into the surrounding subsoil, and is preferably positioned at a point adjacent where water seepage, leakage or flow occurs. Normally, a star drill or jackhammer may be utilized to perforate the wall, such as a concrete block wall, and the sleeve driven into place. A flanged coupling means is normally secured to the proximal end, and a water conduit may be coupled internally of the flanged end. Also, the inner surface of the flanged end may be used to receive a caulking bead so as to render the device substantially tightly sealed against the basement wall surface.

Therefore, it is a primary object of the present invention to provide an improved apparatus for relieving static subterranean water heads which surround subterranean walls, and which includes a perforated hollow sleeve arranged to extend through the wall and into the surrounding subterranean water.

It is a further object of the present invention to provide an apparatus for relieving static subterranean water heads which includes a perforated hollow sleeve or tube which is provided with a flanged coupling adjacent the proximal end thereof for coupling a water transmitting conduit internally thereof.

It is yet a further object of the present invention to provide an improved apparatus for relieving static subterranean water heads surrounding subterranean walls which comprises a perforated hollow sleeve having a distal end tip which is tapered substantially to a point, and with the tip being of generally solid construction.

Other and further objects of the present invention will become apparent to those skilled in the art upon a study of the following specification, appended claims, and accompanying drawings.

IN THE DRAWINGS

FIG. 4 is a side elevational view of an elbow structure which may be used to couple the proximal end of the device to a water-carrying conduit such as a hose or the like;

DESCRIPTION OF THE PREFERRED EMBODIMENT

Figure 1:
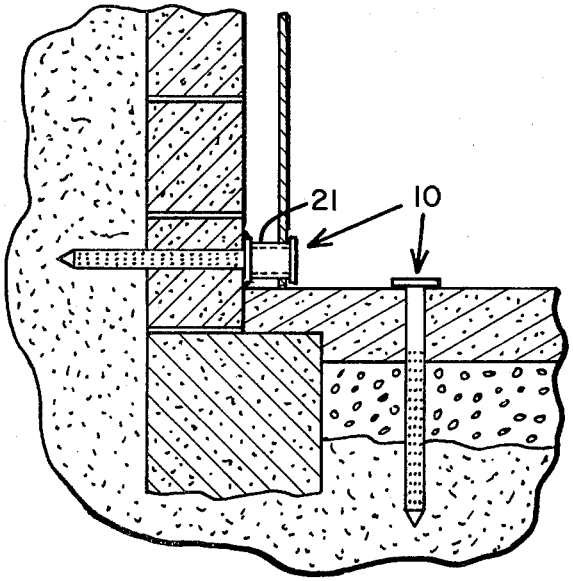
FIG. 1 is a vertical sectional view illustrating two typical installations of the apparatus for relieving static subterranean water heads, with one such installation being in a basement sidewall, and with the other being in a basement floor, and with the wall installation showing a pre-existing panel formed therein.
Figure 2:
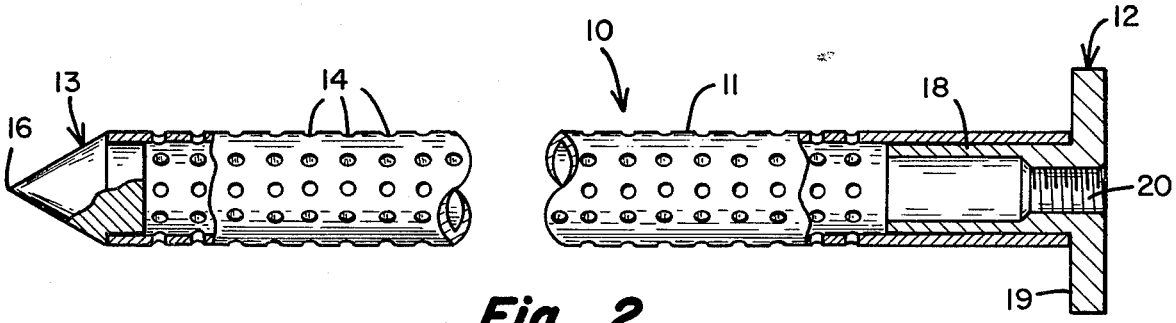
FIG. 2 is a side elevational view, partially in section, and with a portion of the center segment being cut away and removed, and illustrating that detail of the structure with an internal flanged sleeve disposed adjacent the proximal end.

With attention now being directed to FIGS. 1 and 2 of the drawings, the apparatus for relieving static subterranean water heads shown generally at 10 includes a perforated hollow sleeve body 11 which is arranged to extend through a subterranean wall and into a subterranean water head. The sleeve member 11 has a proximal end as at 12 and a distal end as at 13. Perforations are formed along the length of the sleeve 11, such as are illustrated at 14—14, it being observed that each of the bores has a certain predetermined area. The sleeve 11 is provided with such spaced bores substantially entirely along the length thereof, so as to permit flow of water therethrough.

With attention now being directed to the distal tip end 13, it will be observed that the tip 13 is tapered to a pointed tip as at 16, with the pointed tip portion or end being substantially solid, as indicated. While the distal tip end 13 may be formed integrally with the sleeve 11, tip 13 may also be formed separately, such as of a durable metal or the like.

A flanged coupling means is coupled adjacent the proximal end 12, as at 18, with the flanged member 18 having an inner surface 19 for receiving a caulking bead thereabout, and also being internally threaded as at 20. The internal threading will permit coupling of a water-carrying conduit internally of the structure, and will not interfere with the seal previously provided by the caulking bead arranged on flange surface 19. Also, it will be observed that flanged member 18 is imperforate, thereby providing a zone or area adjacent the proximal end which is substantially watertight. Such an arrangement may be desirable in certain installations, such as those installations where it is undesirable to have openings formed in a hollow block wall, and further in those installations where it may be desirable to isolate or eliminate drainage from the sleeve member in a zone between the inner surface of a block wall and a paneled interior surface.

Figure 3:
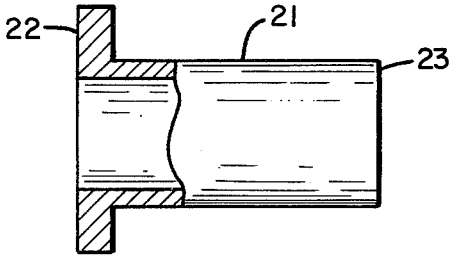
FIG. 3 is a detail side elevational view, partially in section, and illustrating a flanged sleeve which may be secured to the device for mounting on pre-existing panel walls.

In connection with those devices being installed in pre-existing paneled walls, a sleeve such as is illustrated in FIG. 3 will normally be employed, with such sleeve being mounted exteriorly of the member 11, with one such sleeve being shown in FIG. 3 as at 21. Flanged surface 22 is available for providing a caulking bead adjacent the block wall, with end 23 being generally concealed, fitting normally over the proximal end of the sleeve 11.

Figure 4:
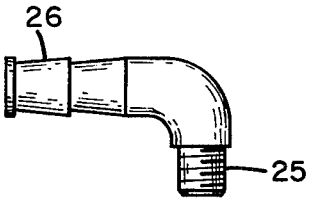
Figure 5:
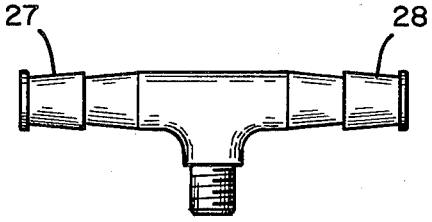
FIG. 5 is a side elevational view of a "T" fitting which may be used to interconnect two apparatus of the type illustrated in FIG. 2.

Attention is now directed to FIGS. 4 and 5 which illustrate typical fittings which may be employed in combination with the device of FIG. 2. The elbow of FIG. 4 has a female threaded portion as at 25 for mating with internally threaded bore 20, along with a tubing coupling end 26 which may be coupled to conventional tubing, common garden hose, or the like for transporting the incoming water to an appropriate drain. FIG. 5 is a "T" member which may be used to interconnect two sleeves of the type illustrated in FIG. 2, with a conduit leading from end 27, extending to an adjacent hollow sleeve member of the type illustrated in FIG. 2, and with end 28 leading, for example, either to an additional such device, or to a drainage source.

In order to permit proper flow and flow which is consistent with the installation, it is normally desirable that the aggregate area of the individual openings 14—14 formed in the hollow sleeve be substantially equal to the minimum cross-sectional area of the hollow sleeve. This matching of area is utilized for purposes of maximizing effectiveness of the device, while permitting all openings to receive an influx of water.

In certain installations, it may be desirable from time to time to couple the device to a source of water under pressure, such as municipal or city water pressure, wherein the individual bores formed in the hollow sleeve are flushed out, thus restoring the device to operation at substantially full capacity.

Figure 6:
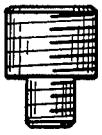
FIG. 6 is a side elevational view of a threaded adaptor for permitting a hose to be coupled substantially directly to the apparatus illustrated in FIG. 2.
Figure 7:
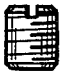
FIG. 7 is a plug device which may be inserted in the proximal end of the apparatus of FIG. 2 when use is not required.

Attention is now directed to FIG. 6 of the drawings wherein an adaptor is shown for permitting and coupling to the female end of a garden hose. The device of FIG. 7 is a plug which is utilized to insert into the threaded proximal end of the sleeve in periods of non-use.

Figure 8:
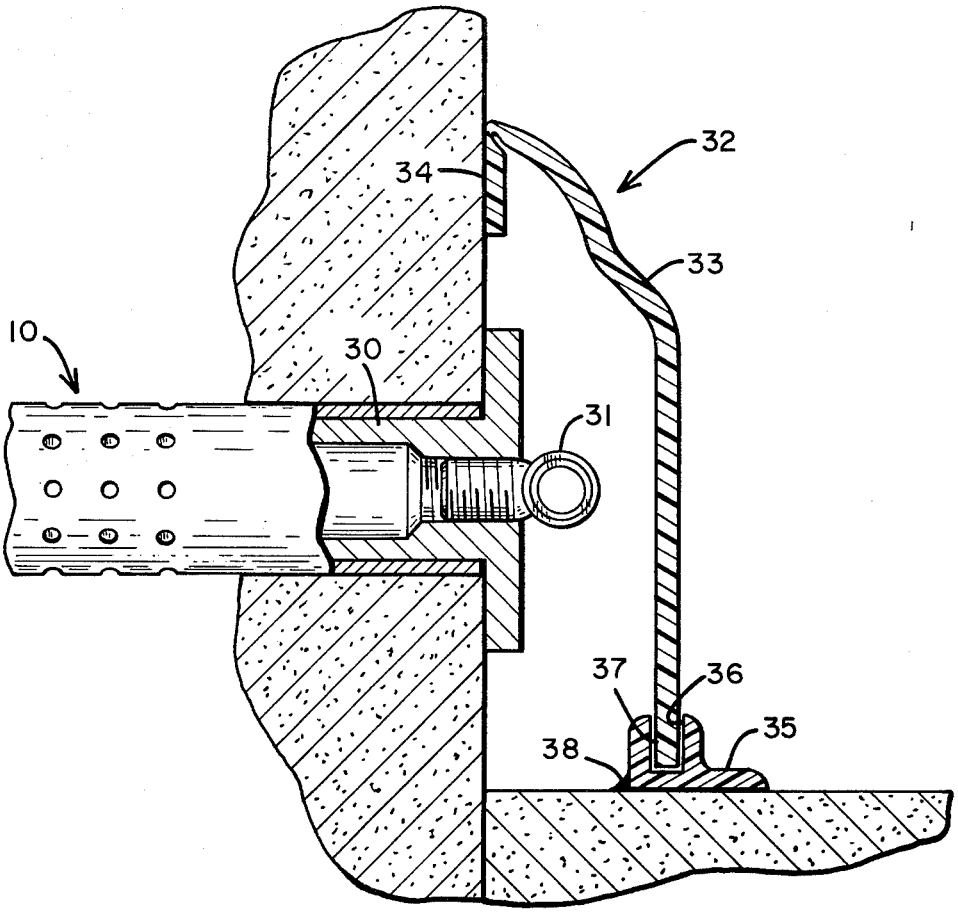
FIG. 8 is a side elevational view, partially in section, illustrating a typical installation of the apparatus shown in FIG. 2, and wherein a mopboard is secured to the wall to conceal the structure and the conduits leading to the drain.

Attention is directed to FIG. 8 of the drawings wherein an installation is illustrated with a mopboard being used to conceal the device. Specifically, a sleeve member of the type illustrated in FIG. 2, is illustrated again at 10 for purposes of convenience, with the proximal end being provided with a flanged sleeve as at 30. Internal threads are provided to receive elbow 31, with elbow 31 being, in turn, coupled to a length of water-carrying conduit or tubing. A mopboard structure is illustrated generally at 32, with a mopboard including a body segment 33 along with a sealing tab being shown at 34. A base mounting pad is illustrated at 35, with pad 35 having a channel formed therewithin as at 36 for receiving the base or bottom tip section 37 of mopboard structure 32. The pad 35 may be secured to the surface of the floor with a conventional adhesive, and if desired, a caulking bead may be provided as at 38 to eliminate outflow of water that may seep into the structure.

Conventional materials of construction may be employed, and sleeve 11 may be manufactured from either metal or plastic, with such plastics as ABS or PVC being found usable.

What is claimed is:

1. Apparatus for relieving static subterranean water heads surrounding subterranean walls which comprises:

(a) perforated hollow sleeve means arranged to extend through a subterranean wall and into a surrounding water head at a level below the top of the subterranean water table, and having distal and proximal ends with said perforations being generally radially extending bores formed along the length of said sleeve and with each of said bores having a predetermined area;

(b) said distal end being tapered substantially to a pointed tip axially of said hollow sleeve, with said tip being of generally solid construction; and (c) flanged coupling means formed adjacent said proximal end for coupling water conduit internally thereof.

2. The apparatus as defined in claim 1 being particularly characterized in that imperforate sleeve means are provided adjacent said proximal end for rendering only a portion of said perforated hollow sleeve substantially watertight.

3. The apparatus as defined in claim 1 being particularly characterized in that the predetermined aggregate area of said radial bores formed in said sleeve and extending into said subterranean water head is substantially equal to the minimum cross-section of said hollow sleeve.

* * * * *